US007101112B2

(12) United States Patent
Burns et al.

(10) Patent No.: US 7,101,112 B2
(45) Date of Patent: Sep. 5, 2006

(54) SECURITY BARRIER

(76) Inventors: Robert Burns, 808 Dowling Way, The Villages, FL (US) 32162; Dennis Darling, 16005 5th St. East, Redington, FL (US) 33708; Paul Hurlburt, 2 Arbor Crossing, Kennebunk, ME (US) 04043; Gary Ketner, 17323 146th Pl. NE., Woodinville, WA (US) 98072

( * ) Notice: Subject to any disclaimer, the term of this patent is extended or adjusted under 35 U.S.C. 154(b) by 40 days.

(21) Appl. No.: 10/832,654

(22) Filed: Apr. 27, 2004

(65) Prior Publication Data

US 2005/0238424 A1 Oct. 27, 2005

(51) Int. Cl.
*E01F 13/00* (2006.01)

(52) U.S. Cl. ..... 404/6; 49/49; 49/131

(58) Field of Classification Search ..... 404/6, 404/15; 49/49, 131; 256/1, 13.1
See application file for complete search history.

(56) References Cited

U.S. PATENT DOCUMENTS 3,748,782 A * 7/1973 Reynolds ..... 49/49
4,490,068 A * 12/1984 Dickinson ..... 404/6
4,572,080 A * 2/1986 Williams et al. ..... 104/252
4,576,508 A * 3/1986 Dickinson ..... 404/6
4,666,331 A * 5/1987 Riley ..... 404/6
4,715,742 A * 12/1987 Dickinson ..... 404/6
4,752,152 A * 6/1988 Crisp et al. ..... 404/6
4,824,282 A * 4/1989 Waldecker ..... 404/6
4,826,349 A * 5/1989 Nasatka ..... 404/6
4,828,424 A * 5/1989 Crisp, Sr. ..... 404/6
4,850,737 A * 7/1989 Nasatka et al. ..... 404/6
4,934,097 A * 6/1990 Quante ..... 49/49
4,947,698 A 8/1990 Dodds
4,974,991 A * 12/1990 Mandavi ..... 404/6
5,425,595 A * 6/1995 Roper ..... 404/9
5,462,384 A * 10/1995 Arlandis ..... 404/6
5,474,017 A * 12/1995 Mohebbi et al. ..... 116/209
5,499,887 A * 3/1996 Verra ..... 404/6
5,639,178 A * 6/1997 Wilson et al. ..... 404/6
5,829,912 A * 11/1998 Marcotullio et al. ..... 404/6
5,975,792 A * 11/1999 Goeken et al. ..... 404/6
5,993,104 A * 11/1999 Marcotullio et al. ..... 404/6
6,099,200 A 8/2000 Pepe
6,224,291 B1 * 5/2001 Mateychuk ..... 404/6
6,312,188 B1 * 11/2001 Ousterhout et al. ..... 404/6
6,626,606 B1 9/2003 Johnson
6,896,443 B1 * 5/2005 Ousterhout et al. ..... 404/6

OTHER PUBLICATIONS

Delta Scientific Corporation, TT210 Hydraulic/Pneumatic/ Manual Bollard System, www.deltascientific.com/tt210-2htm, 1 pg.
Delta Scientific Corporation, TT203 Hydraulic/Pneumatic/Manual Bollard Systems for Intermediate Security, www.deltascientific.com/tt203-2htm.
Delta Scientific Corporation, Bollards Overview, www.deltascientific.com/bollards2.htm. 3 pgs.
Delta, Protect Your Facility and Its Aesthetics! Architecturally-Enhanced High Security Bollard Systems. www.deltascientific.com, 4 pgs & 2 drwgs.

(Continued)

*Primary Examiner*—Gary S. Hartmann
(74) *Attorney, Agent, or Firm*—David McEwing

(57) ABSTRACT

An apparatus and method for installing and deploying a barrier utilizing one or more gas generators. The invention includes a barrier component installed beneath the ground surface or substantially parallel to the ground and raised by activation of the gas generator. The device can be trigger automatically without human intervention and thereby faster deployment of the barrier. The invention permits the passage of pedestrians, vehicles, etc. or activation into a barrier position.

23 Claims, 18 Drawing Sheets

OTHER PUBLICATIONS

ARMR Services Corporation, Specification for Model 820 Shallow Mount Vehicle Barricade, wwwarmrservices.com, Fairfax, VA 1 pg & drwg.
ARMR Services Corporation, Specifi ations for Model B-30 High Security Vehicle Access Control Bollard System, etc, 14 pages & 1 drwg.
B&BARMR, Surface Mount Barriers, www.bb-armr.com/products/anti-terrorist/surfacemount, 2003 1pg.
ARMR Services Corporation, Specification for Model 890 Surface Mounted Vehicle Barricade, www.armrservices.com, Fairfax, VA 1 pg & drwg.
Markland Technologies, Vehicle Stopping System (VSS), 2003 2 pgs.
Perimeter Defense Technologies, Uncompromising Security, Flexible Design K12/L3 Retractable Bollards., 2003 Midland, TX 5 pgs.
Norshield Security Products, Vehicle Access Control—Bollards and Barriers, www.norshieldsecurity.com/Bollards_Barriers.htm 2202. 4 pgs.
Intertex Companies, Counter Terrorist Systems, 1999, www.intertex-gc.com/counter_terrorist_systems.htm.
Nasatka Barrier, Inc., Specifications Model NMSB XV, Clinton, MD 2003 10 pgs.

* cited by examiner

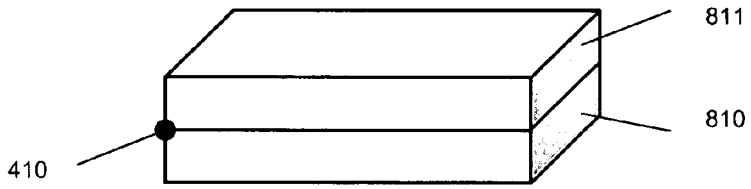
FIG. 8
FIG. 8A
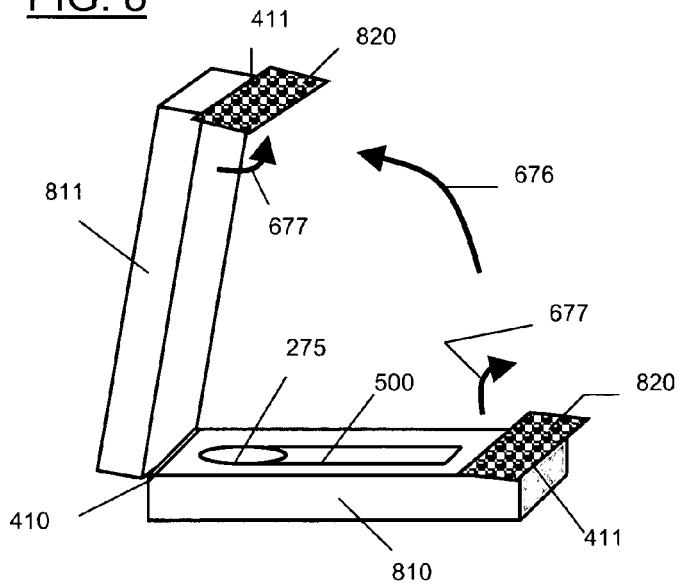
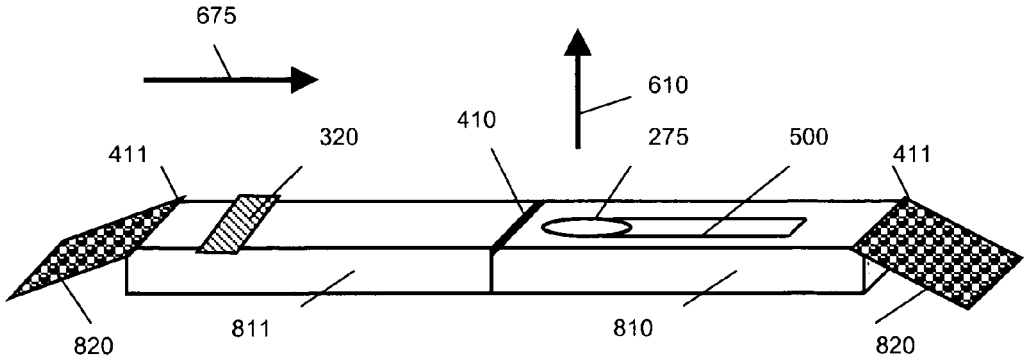
FIG. 8B

SECURITY BARRIER

BACKGROUND OF INVENTION

1. Field of Use

The invention pertains to a high strength impact resistant and rapidly deployable security barrier for the protection of persons and property from objects such as trucks and cars traveling at ground surface level.

2. Prior Art

Vehicle and traffic barricades are well known and are in wide use for building and personnel security applications. These systems can be permanent or temporary. The barricades can be stationary or mobile with relatively rapid deployment for raising/lowering. The barricades can be wall like sections providing a resistive mass of reinforced concrete or hollow resinous plastic structures filled with water. Other types of traffic or vehicle control barriers are bollards that are fixed in position or that can be raised and lowered from the ground surface level.

Bollards have been shown to be capable of incapacitating or stopping vehicles up to 7.5 tons GVW moving at speeds of 50 mph. The current raisable bollard systems have deficiencies that have been demonstrated based on current world events and terrorism threats. These deficiencies are related to their dependency on human interaction to deploy the barrier of the bollard system, they are slow to activate, provide inadequate capabilities to prevent intrusion, and they are dependent on electric power or air systems which can be compromised by threats. The mechanism used to power the raising and lowering can be springs, hydraulics, motors or gas cylinders. However, existing bollards or barriers that are raised to selectively block or control vehicle movement require either human intervention that retards deployment time, thereby diminishing effectiveness, or do not have sufficient mass to effectively block a large or heavy vehicle. Other bollard/barrier devices require installation beneath the ground surface level and separately powered control and motor mechanisms to raise (deploy) the barrier.

There is accordingly a need for a rapidly deployable barrier system having sufficient capability to provide an effective barrier to heavy motor vehicles. There is also a need for a non-obtrusive barrier protective system than can be easily and quickly installed and removed.

SUMMARY OF INVENTION

The invention pertains to a method and apparatus for erecting protective barriers/bollards utilizing a gas generation system (gas generator) to power the raising of the barrier structure to block the passage of a vehicle. The gas generator can be activated by a variety of means and independent of human intervention. The energy supplied by the gas generator allows deployment of the barrier from a stored to protective position at a speed significantly greater than achieved by existing methods. This allows the activation device to be placed close to the barrier, thereby permitting use of an automated barrier protective system in relatively confined spaces with minimized instances of unintended or unnecessary activation.

The gas generator power source also permits a variety of mechanical mechanisms for raising the barrier from a stored to protective position. The barrier can be raised in a relatively straight direction substantially normal to the plane of the ground surface. The barrier can also be raised from a stored position relatively parallel to the plane of the ground surface level to a position normal to the plane.

The activation of the barrier component of the barrier system can be achieved by a variety of means. One method would be activation occurring in response to the wheels of a motor vehicle passing over a pressure sensitive triggering mechanism. It will be readily appreciated that the pressure sensitivity can be adjusted to distinguish between a motor vehicle and a pedestrian.

The activation of the barrier system may also be a motion detector, or a magnetic, strain, chemical, infra-red or radiation sensor. A remote sensor can signal activation by RF signal, requiring little power. The power source may be batteries or similar independent means, thereby minimizing deactivation of the protective system by power failure or sabotage.

It is therefore an object of the invention to provide a rapidly deployable barrier.

It is another object of the invention to provide a barrier system that has a minimal visual impact to the protected structure or for protective surveillance.

It is a further object of the invention to provide a barrier that can be activated without human intervention.

It is another object of the invention to provide a barrier that can be quickly installed and removed.

It is another object of the invention that the protective barrier can be portable and installed with minimal site preparation.

Another object of the invention is a protective barrier system without preparation or intrusion beneath the ground surface level.

It is also an object of the invention to provide a protective system that is operational/activation energy self-contained.

Other benefits of the invention will also become apparent to those skilled in the art and such advantages and benefits are included within the scope of this invention.

SUMMARY OF DRAWINGS

The accompanying drawings, which are incorporated in and constitute a part of the specification, illustrate preferred embodiments of the invention. These drawings, together with the general description of the invention given above and the detailed description of the preferred embodiments given below, serve to explain the principles of the invention.

FIGS. 8, 8A and 8B are illustrations of a portable and rapidly installed system.

DETAILED DESCRIPTION OF INVENTION

Figure 1:
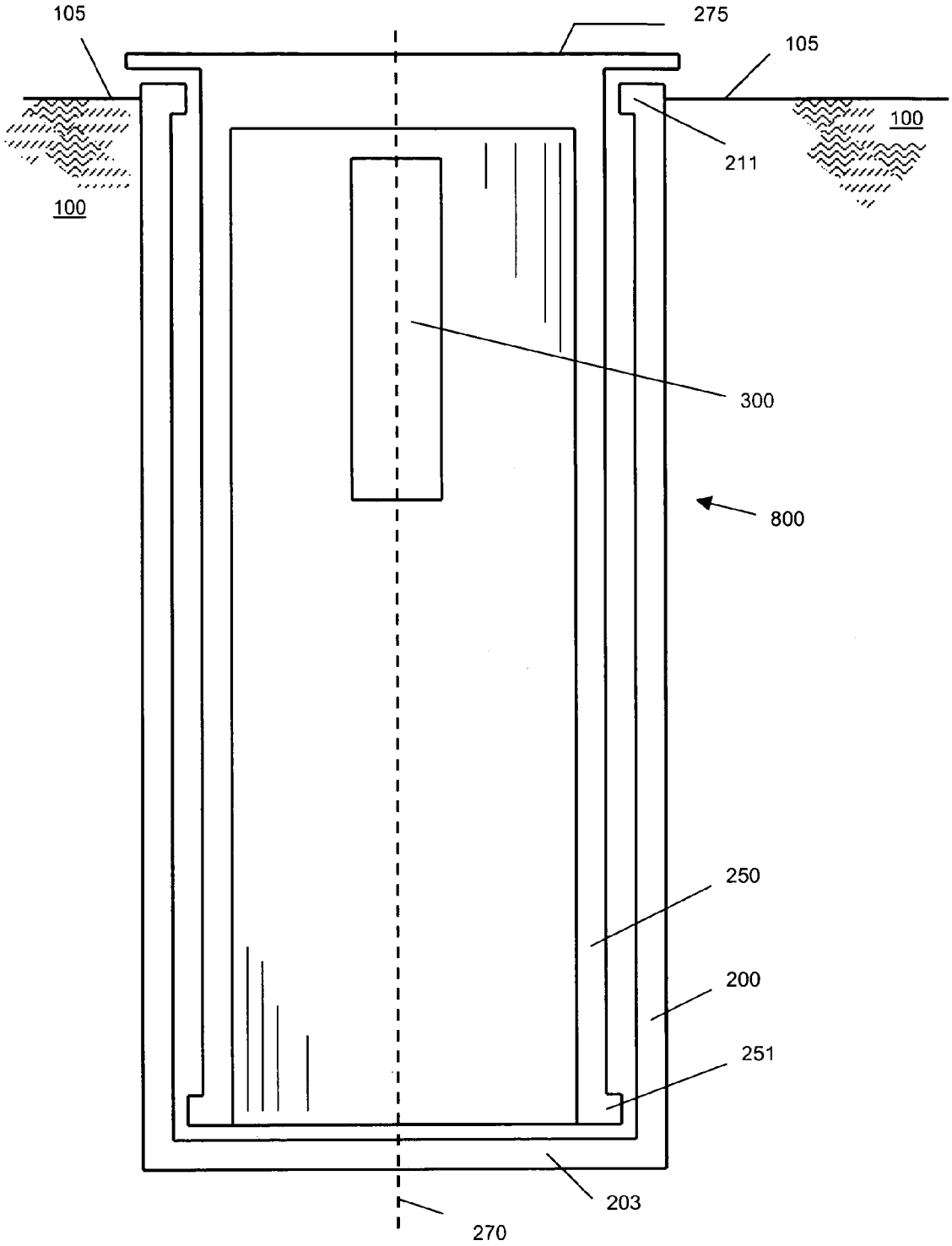
FIG. 1 is a schematic cross sectional view of one embodiment of the invention comprising an outer cylinder and an inner piston-like cylinder installed substantially below the ground surface.

The above general description and the following detailed description are merely illustrative of the subject invention and additional modes, advantages and particulars of this invention will be readily suggested to those skilled in the art without departing from the spirit and scope of the invention. The requirements for the barrier system will vary based on the intended application. These variations are related to the denial requirements, the type of installation (permanent or temporary), location of the system, and the type of asset to be protected.

The invention proposed consists of an autonomous or automatic barrier or barrier restraint system, including automatic trigger sensors, communication devices to deploy the barrier component of the systems, automatic sensors to detect or activate the system, and an independent, self contained power supply to provide monitoring, activation, or alarm.

Deployment of the barrier component, regardless of the specific configuration of the barrier system, e.g., bollard, gate or wall-like sectional barrier, will be carried out by a gas generator. The gas generator will be integral to the system and be capable of deploying a barrier which is capable of stopping a 15000 lb gross vehicle weight (GVW) vehicle and which deploys the barrier in 150 milli-seconds or less. This is nominally 10 times faster deployment than the fastest barrier currently available and the proposed system does not depend on any human interaction which requires significant additional time. What this means is that a vehicle moving at 50 mph will travel 110 ft in 1.5 seconds. The proposed invention will permit 11 feet or less of travel at 50 mph from the time the barrier is activated until the vehicle is stopped. Add to the conventional system the time required for personnel to activate it and this would require detection of the threat and activation of the restraint system nominally 100's of feet before the vehicle reaches the barrier.

The gas generator will be integral to the restraint device. The gas generator will contain solid propellant that upon combustion creates heated gas to rapidly expand within a cylinder that raises the barrier component into its operating position. A mechanical mechanism will lock the restraint device into place. The propellant is ignited by a device termed a squib or igniter. The squib receives an electric signal from the integral power supply. This electrical signal may be activated manually or automatically depending on selection of how the restraint system is configured. The receipt of the signal to activate the squibs is received via radio frequency (RF) which can be encrypted as necessary for security reasons. The RF can also be sent by detectors that can detect motion, magnetic field, radiation, mass, chemicals or explosives.

As an alternative to the gas generator, the restraint system could also be deployed through of a stored high-pressure gas or mechanical energy storage devices such as springs. Activation of the device would occur through an electro-mechanical switching device that will release the stored gas or the compressed springs. These devices will be slower to provide deployment than a gas generator and these types of devices will result in increase weight and maintenance requirements. The alternate systems do not utilize ordnance, however, the gas generator technology is very mature and they are commonly used in automobiles, aircraft evacuation slides and munitions dispensing.

The drawings contained within this specification illustrate various embodiments of the invention. In addition to the traditional bollard (e.g. a typically round structure that protrudes above the ground level), this invention also includes a rapidly deployable barrier that is activated using both a gas generator and an automatic or manual deployment device as described previously. This system, called a "Toggle Retractable Barrier System" can be permanently installed on a roadway or other ground level surface or in a shallow recess. The "Toggle" system is held in a horizontal position until deployed. Referring to the models below, the structural member (or stability member) serves as a cover for the system and protects the deployment mechanism until activated. Upon activation, the pressure resulting from the gas generator drives a cylinder which raises the stability member (or barrier) into an upright position. The locking mechanism shown in the model locks the stability member into position. This design is very flexible in that it is portable and may be configured to accommodate multiple barriers in series or parallel. A benefit of this design is that the barrier takes advantage of the vehicle mass in anchoring the system to the ground. These system designs may be deployed individually in a pattern or all simultaneously depending on the instructions provided to its communication component.

The system subject of this invention may also be constructed of various materials having high compression, shear and tensile strengths. Although these materials include metals, particularly ferrous metals, fiber reinforced composite materials may be used, particularly where light weight is desired. Such designs may be combined with components allowing weight to be added to the system after placement in the selected location.

The end uses of this invention are to protect vital assets and personnel from terrorist acts. A barrier system is applicable to embassies, power plants fuel storage depots, military and industrial installations, traffic control, and critical industrial facilities.

The subject invention will utilize the same technology in terms of stopping the vehicle but will perform this function with/without human intervention. In other words, the bollard system can be made autonomous with its own sensors and triggering system. Where human intervention activates the bollard or barrier system, the response is rapid (less than 150 milliseconds), thus allowing an operator a last second decision to stop a threat with as little time as 12 feet from the penetration point of the asset being protected.

The invention consists of using a rapidly deployable barrier system activated by a gas generator deployed the barrier. The activation of the gas generator is not dependent on any external support such as electricity or air pressure and is activated by RF signal. The RF signal can be activated by numerous different sensors that detect movement, proximity, light curtains, acoustic, pressure plate, infrared, vision system, chemical detectors, explosive detectors, magnetic or radiation detectors. A key advantage of the RF command link is the ability to configure the system allowing the user to use or not use its variability to detect and activate. Various sensor systems allow the user to configure the activation of the barrier. For example, if the system is configured automatic, an underground magnetic detector could arm the system. A second sensor such as motion or speed detection could trigger the system when detecting the threat indicates it will not stop.

The barrier system may contain its own power through rechargeable power that can incorporate solar cell technology supply. The proposed invention may also have the ability to monitor its status. Therefore, in the event of power failure, the barrier system continues to function and is not compromised. Other systems depend on electric, hydraulic or air to activate their systems. These are all dependent on electric power.

FIG. 1 illustrates a cross sectional view of one embodiment of the invention 800 installed substantially below the ground surface level 105 and within the ground 100. The top covering 275 of the barrier is approximately level with the ground surface 105 so as not to impede the passage of vehicles or pedestrians. The system also does not impede vision or viewing of the object being protected nor does it impede the vision of approach area for surveillance. The barrier 800 is oriented along an axis 270 substantially normal to the ground surface plane 105. The components of the barrier include an outer cylinder 200 and inner cylinder 250. The outer cylinder is closed at the bottom 203. The inner cylinder is closed at the top 275. A gas generator 300 is located within the inner cylinder 250. Detection and activation mechanisms of the barrier are not shown. The inner and outer cylinders 250, 200 have offsetting protruding sub-components 251, 211 which prevent the bottom of the inner cylinder from moving past the top of the outer cylinder. There may also be seals or rings (not shown) installed between the first and second cylinder to contain the expansive gas, thereby directing the energy to the movement of the second cylinder.

Figure 1A:
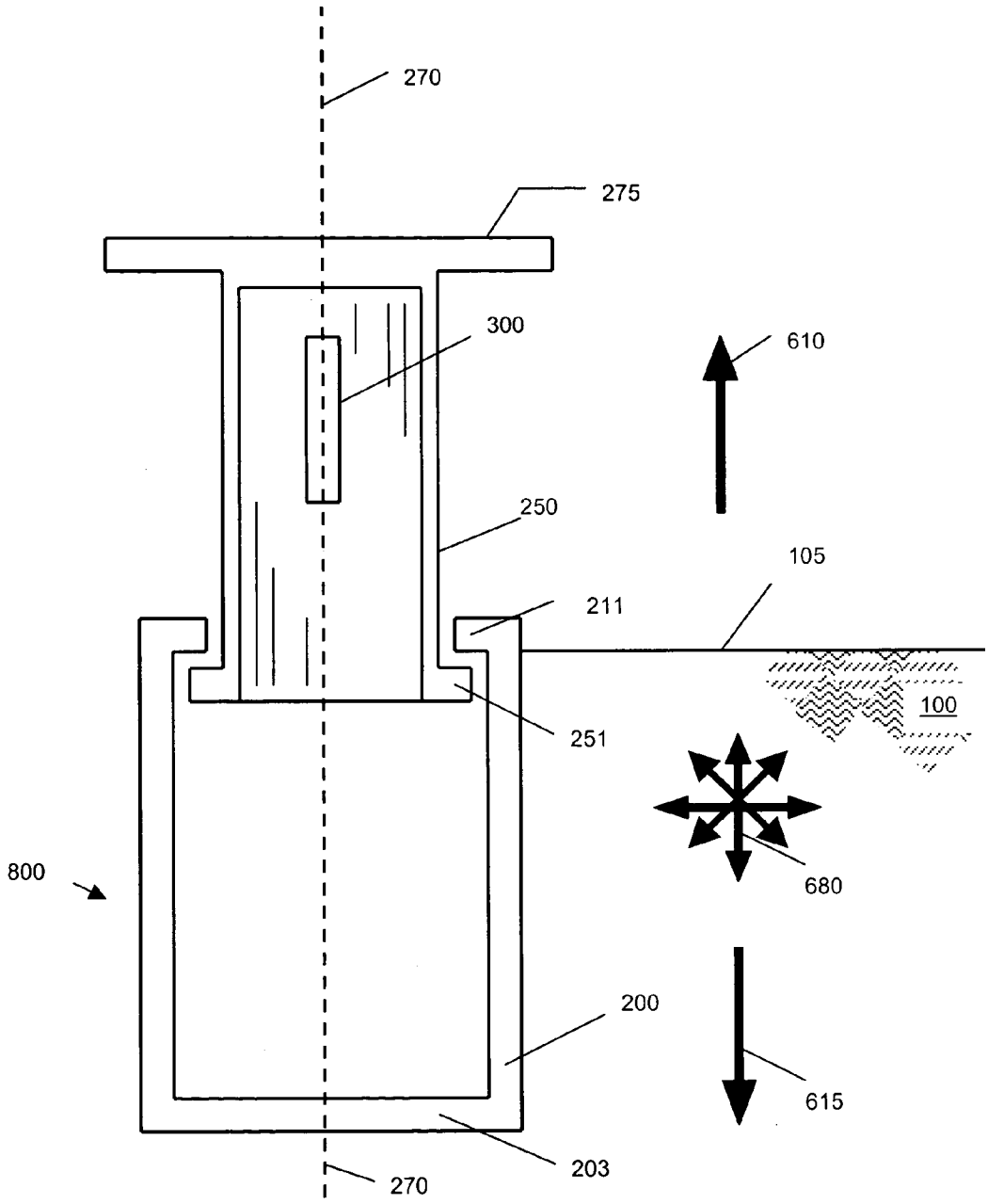
FIG. 1A is a schematic of the embodiment after deployment of the inner cylinder, comprising the barrier component, into a protective position above the ground surface level.

FIG. 1A illustrates the barrier system 800 after ignition of the gas generator 300. The ignition of the gas generator results in a very rapid expanding gas force within the inner cylinder 250. The gas expands in all directions as represented by the vector arrows 680. The expansive gas force is retained by the rigid top and side walls of the inner cylinder 250 but presses downward 615 on the bottom 203 of the outer cylinder 200, thereby causing the inner cylinder 250 to move upward 610 in a piston-like manner along the center axis 270 in relation to the outer cylinder. The inner cylinder thereby is explosively pushed above the plane of the ground surface 105, while the outer cylinder remains anchored in the ground 100. The movement of the inner cylinder is controlled by the complimentary protrusions 211 251 or retaining rings of the outer and inner cylinders.

Figure 2:
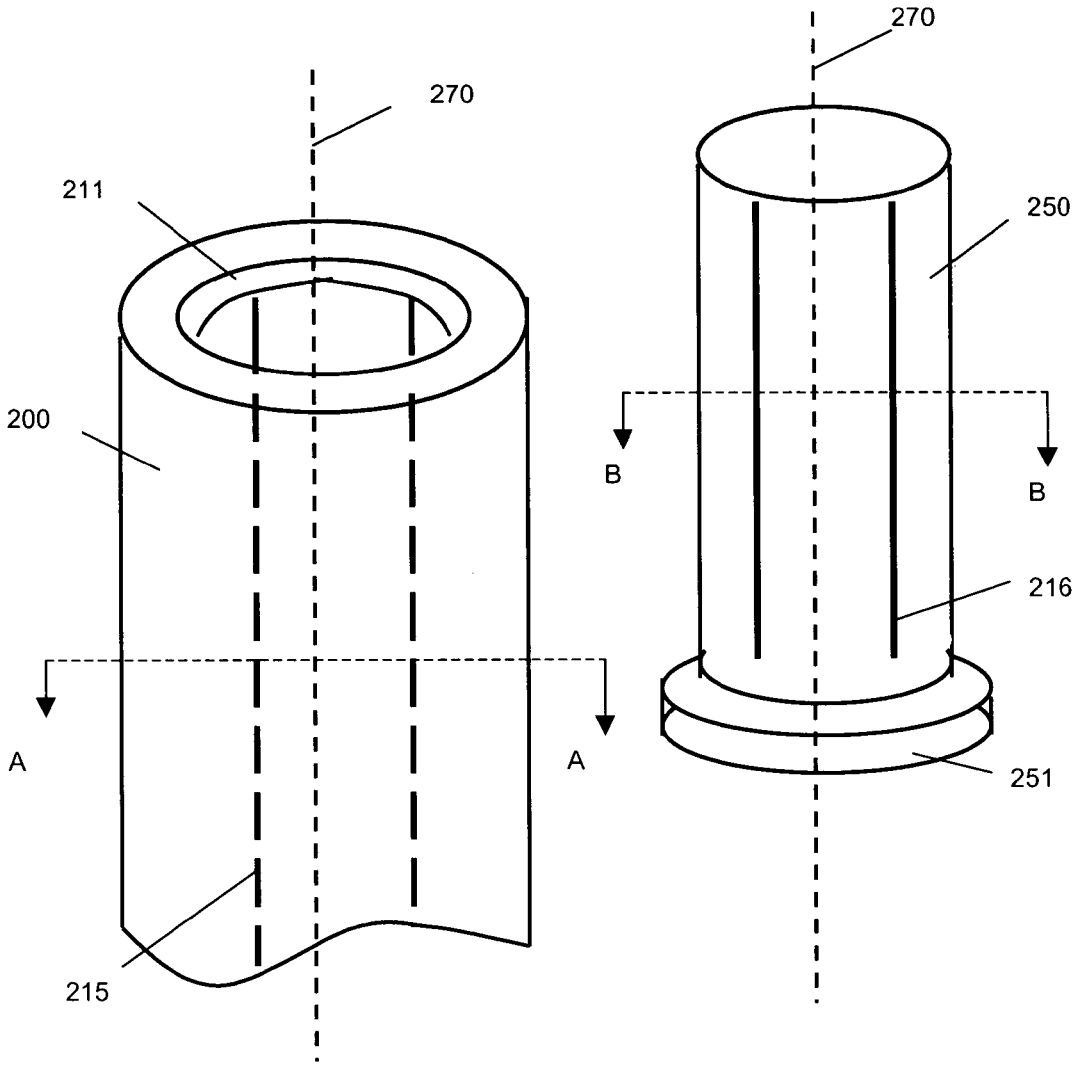
FIGS. 2, 2A and 2B illustrate guides utilized in one embodiment of the invention.
Figure 2B:
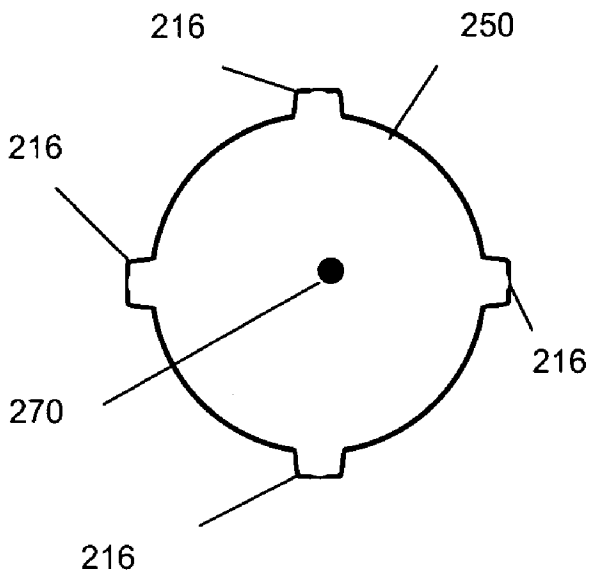
Figure 2A:
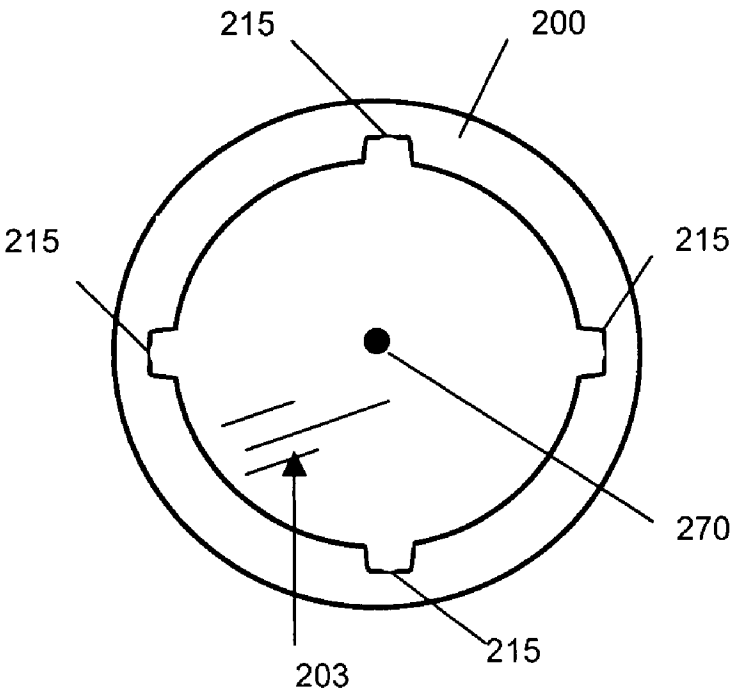

FIGS. 2, 2A and 2B illustrate an embodiment of the invention utilizing piston or cylinder guides 215 and 216 within the walls of the outer cylinder 200 and inner cylinder 250. Also illustrated in FIG. 2 are the retaining rings or ridges 211, 251. For clarity of illustration, the inner and outer cylinders are shown independently, but it will be appreciated that they are installed together in relation to the center longitudinal axis 270. FIG. 2A illustrates a downward cross sectional view of the outer cylinder 200, showing the placement of grooves 215 longitudinally installed in the wall of the outer cylinder. Also illustrated is the cylinder bottom surface 203. FIG. 2B illustrates a downward cross sectional view of the inner cylinder 250, including the complementary protrusions 216 on the outer wall of the inner cylinder. The relationship of the cylinder guides to the center axis 270 is also illustrated. It will be appreciated that the number of guides may be varied. The groove guides may be installed in the outer surface of the inner cylinder 250 with counter part and complementary protrusions installed in the inner wall surface of the outer cylinder 200. The piston or cylinder guides minimize the possibility of the inner cylinder becoming cocked or jammed within the outer cylinder in a direction non-parallel to the center axis 270 when moving in response to the sudden and powerful force of the expanding gas. The jamming could prevent the inner cylinder extending to the full permissible direction above the ground surface (not shown).

Figure 4:
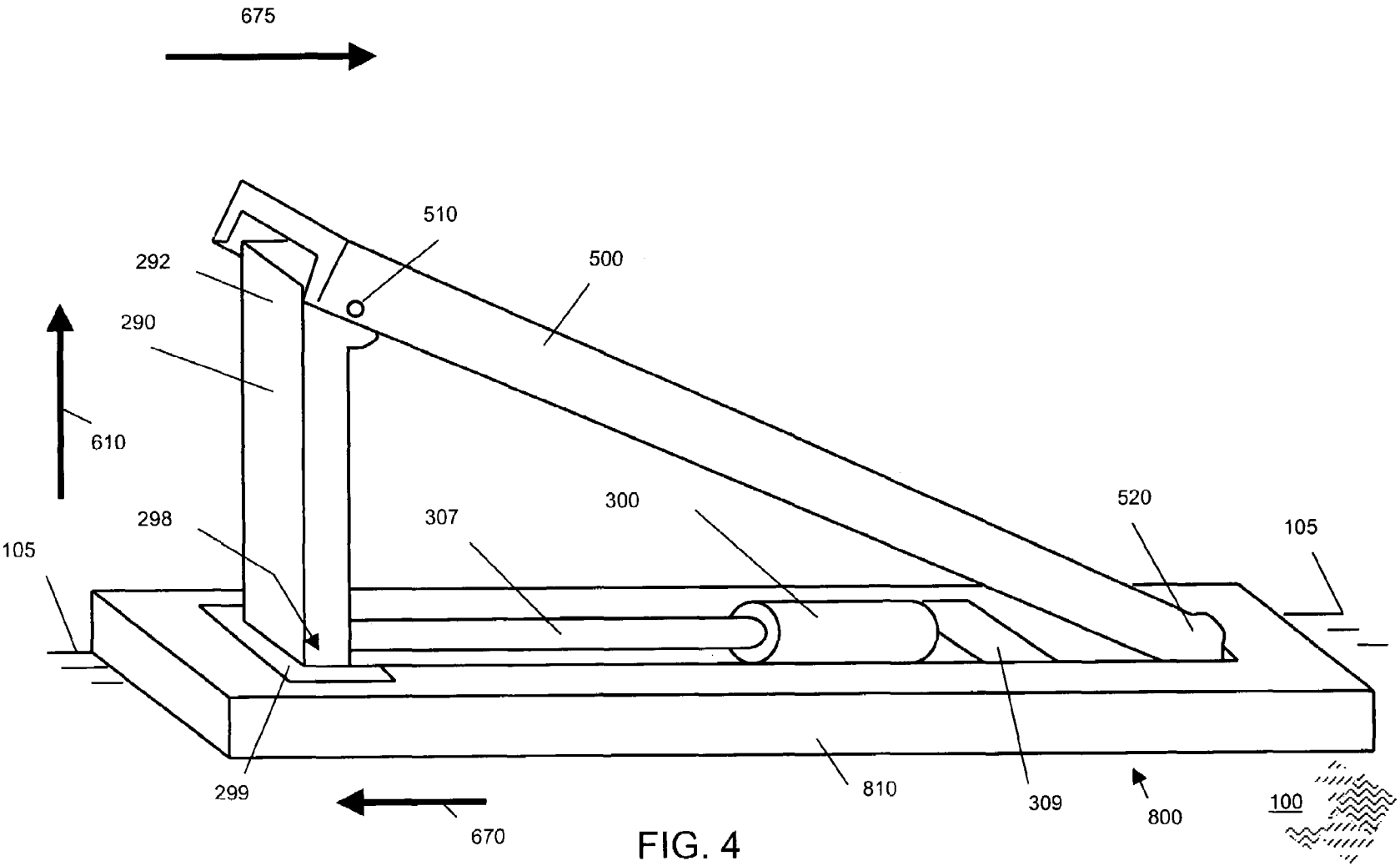
FIG. 4 depicts an additional embodiment of the invention wherein the gas generator and barrier are installed in a position parallel to the ground and normal to the deployed position.

FIG. 4 illustrates another embodiment of the invention 800 wherein the gas generator (not shown) within a first cylinder 300 propels an inner second cylinder or piston 307 in a direction 670 substantially parallel to the ground surface 105. Movement in the opposing direction is prevented by the closed first end 301 secured by attachment mechanism 309 to a base component 810. In an alternate embodiment (not shown), the gas generator may be directly attached to the housing or attachment component (and without containment within a first and second cylinder configuration) and used alone to power the extension of a piston connected to the barrier component. The barrier component 290 is contained within the base component 810 placed on top of the ground 100. The piston is pivotably attached by means of a hinge or pivot device to the bottom segment 298 of the stability member 290. The movement of the piston in direction 670 causes the stability member to be pushed and locked 299 upright in direction 610, being substantially normal to the ground surface 105. It will be understood that prior to activation by the ignition of the gas generator 300, the stability member 290 is stored in a substantially horizontal position within the base 810. The upper portion 292 of the stability member is hingeably attached 510 to a reinforcing structural member 500. The structure member provides reinforcing strength against collapse by a moving object such as a heavy motor vehicle traveling in direction 675.

Figure 4A:
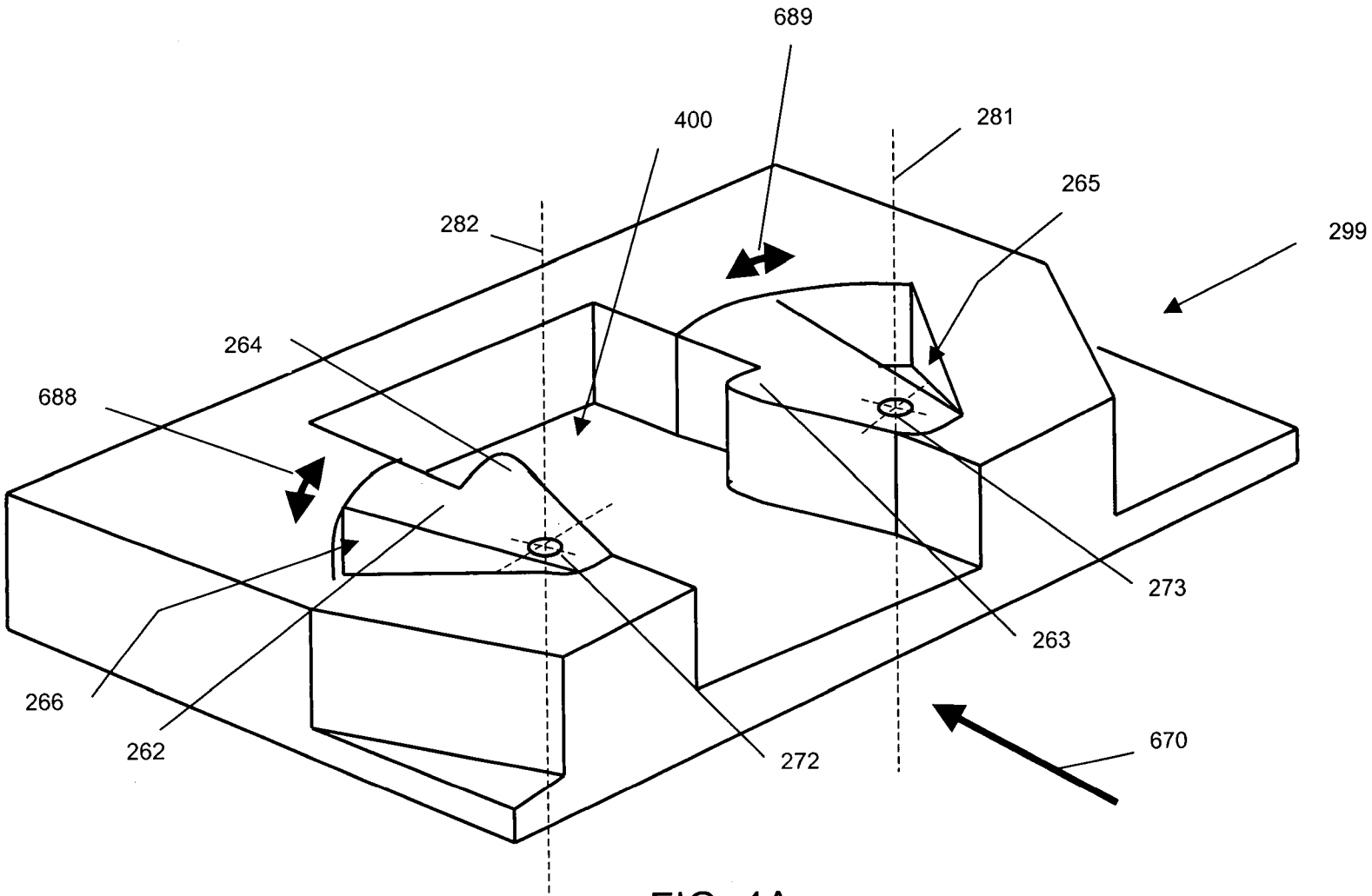
FIG. 4A is an illustration of a barrier base locking component mechanism.
Figure 4C:
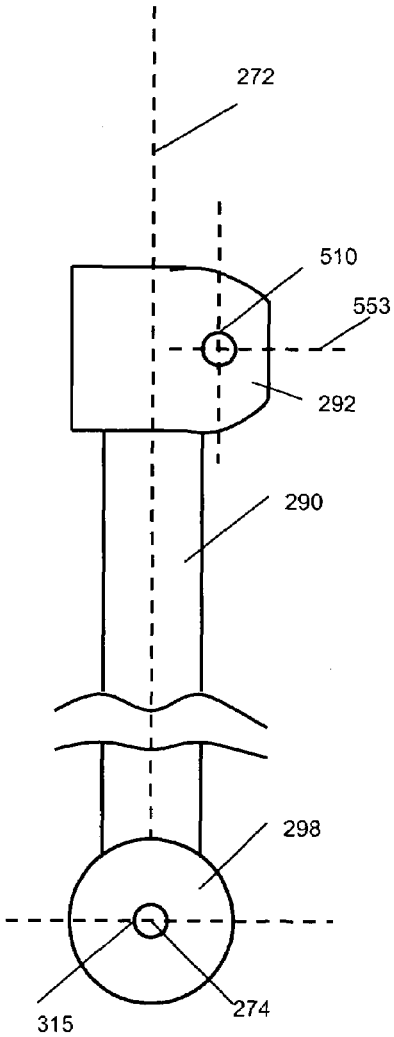
FIGS. 4C and 4D are schematic illustrations of the risible/deployed barrier component of the barrier system.

FIG. 4A illustrates a component 299 of the invention utilized to lock the bottom portion (not shown but being item 298 in FIG. 4) of the barrier component into place within the barrier base structure (also not shown). The bottom portion of the barrier component attached proximate to the piston is moved in the direction 670 in response to the activation of the gas generator. The barrier component is pushed into a space 400 past the locking sub-component mechanisms 262 263. The locking sub-components are pivotably moveable (vector arrows 688 689 on axes 281 282) on pivot sub-components 272 273. As the barrier component is pushed past the locking sub-components, the sub-components are pushed into an annulus 266 265. A spring or similar mechanical device (not shown) can be used to push the locking sub-components into the original position, thereby holding the barrier component in the annulus. As the barrier component is moved in response to activation of the gas cylinder in the direction 670, the top portion of the barrier component 292 may also be deflected upward 610 by a component (not shown).

FIG. 4A illustrates a component 299 of the invention utilized to look the bottom portion (not shown but being item 298 in FIG. 4) of the barrier component into place within the barrier base structure (also not shown). The bottom portion of the barrier component attached proximate to the piston is moved in the direction 670 in response to the activation of the gas generator. The barrier component is pushed into a space 400 past the locking sub-component mechanisms 262 263. The locking sub-components are pivotally moveable (vector arrows 688, 689 on axes 281, 282) on pivot sub-components 272, 273. As the barrier component is pushed past the locking sub-components, the sub-components are pushed into an annulus 266, 265. A spring or similar mechanical device (not shown) can be used to push the locking sub-components into the original position, thereby holding the barrier component in the annulus. As the barrier component is moved in response to activation of the gas cylinder in the direction 670, the top portion of the barrier component 292 may also be deflected upward 610 by a component (not shown).

The locking component 299 can be in conjunction with a component (not shown) to divert the upper section 292 of the barrier component (stability member) 290 toward a vertical position.

Figure 4D:
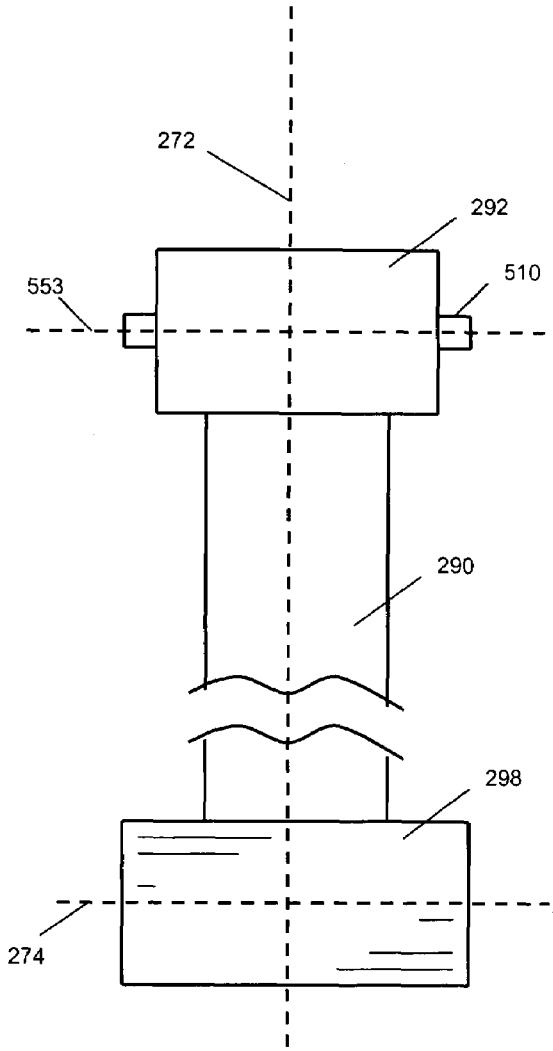
Figure 4E:
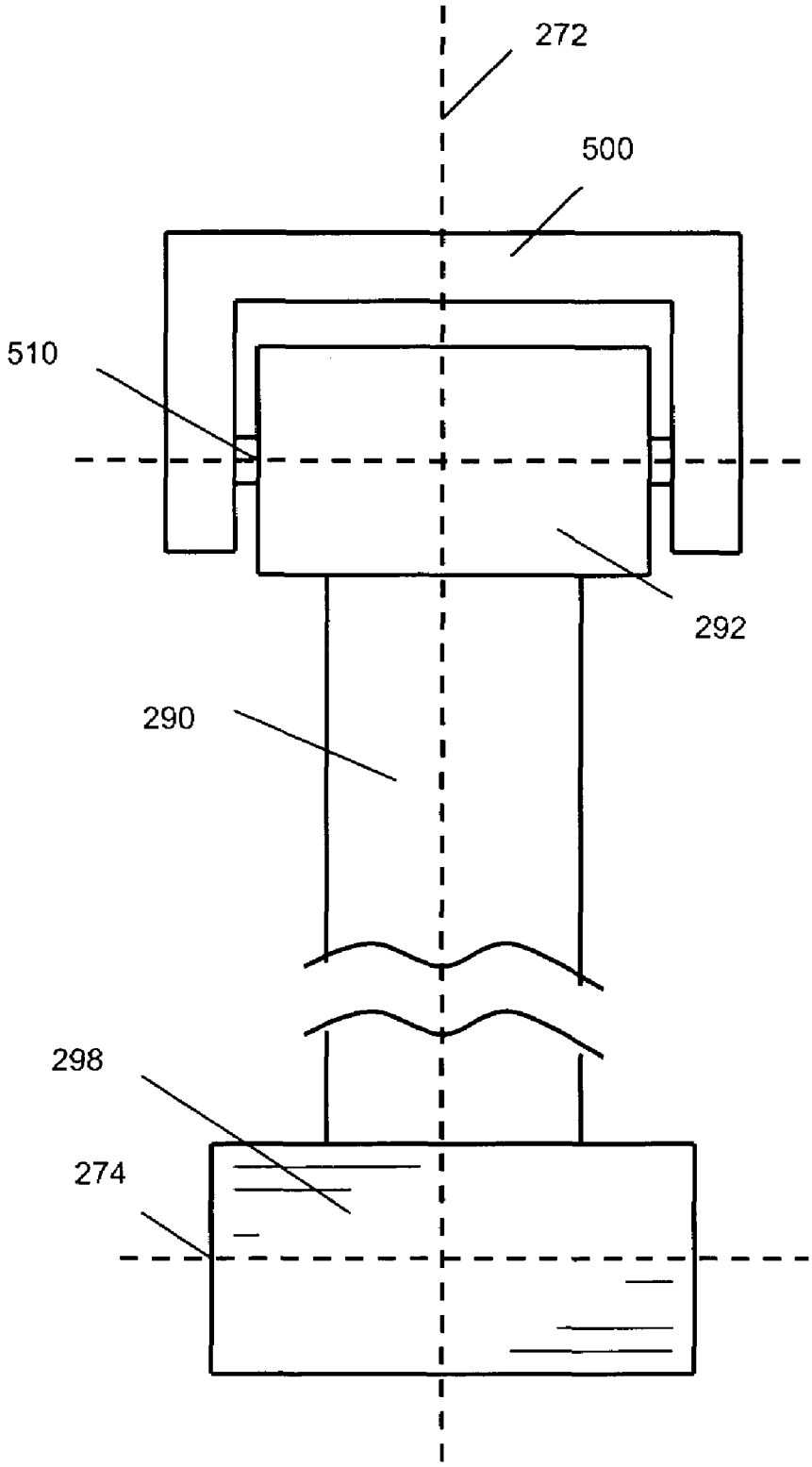
FIG. 4E is a schematic illustration of the coupling mechanism of the barrier stability structure component and structural member component.

FIG. 4E illustrates the relationship of the stability structure 290 with the pivotably attached 510 structural member end 500. The other components illustrated in FIG. 4D are also illustrated in 4E.

Figure 4F:
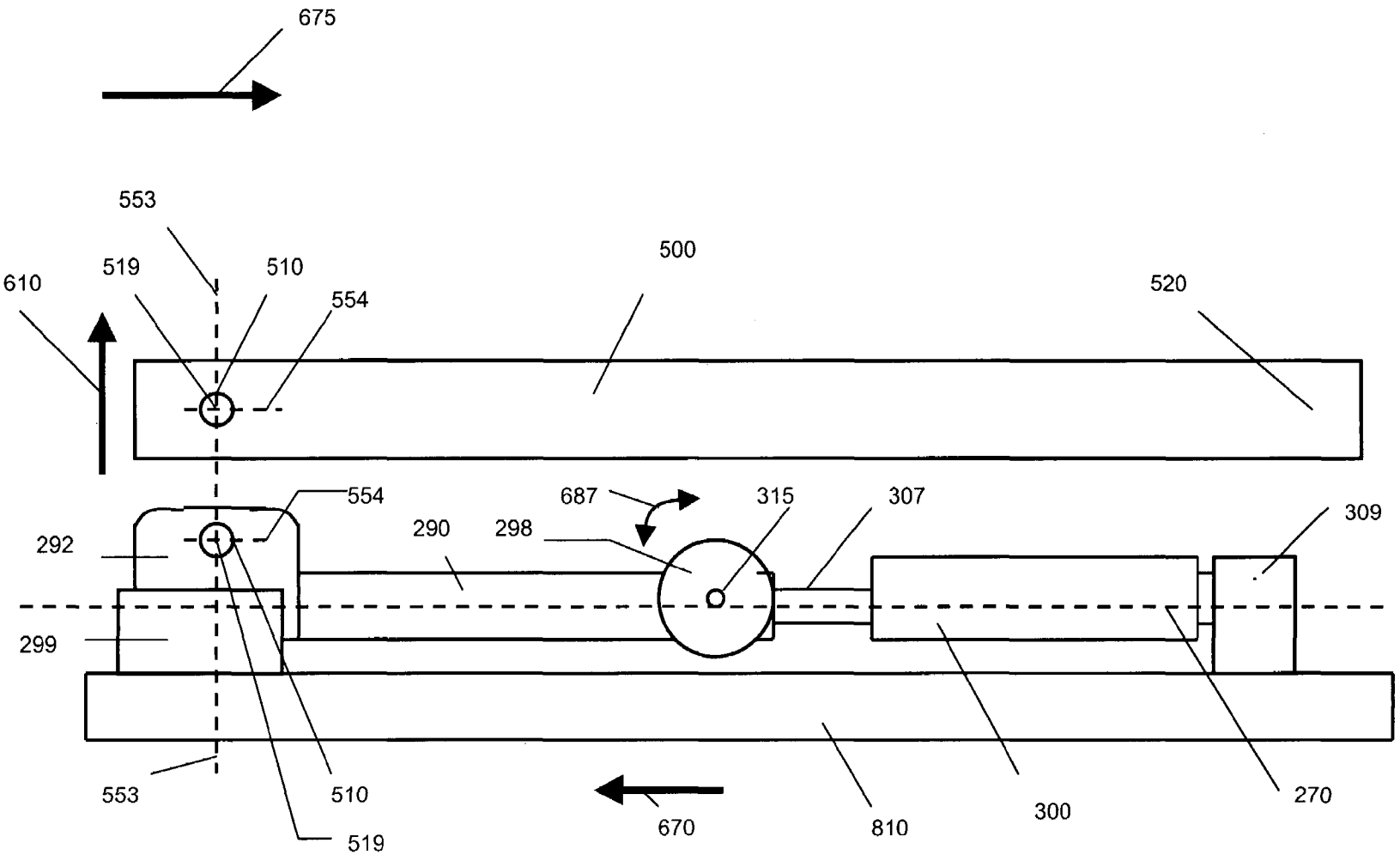
FIG. 4F is a schematic side view depiction of one embodiment of the invention in a stored position.

FIG. 4F is a schematic illustration of the structural member 500, barrier stability member 290, locking mechanism 299, gas generator 300 and piston 307 as they would exist in a stored position prior to activation and along an axis 270. It will be appreciated that the structural member 500 may fit over the other components within the base unit 290. Other components illustrated are the pivot end of the barrier 292 (understood to be actually connected to the structural member 500, the rotatable bottom sub-component 298 attached to the piston by hingeable means 315 (vector arrow 687), and the gas generator attachment means 309. Also illustrated by vector arrow 670 is the direction of movement of the piston 307 powered by the gas generator 300. A vector arrow 610 illustrates the direction of movement of the barrier stability member end 292 raised from the base. A vector arrow 675 illustrates the direction of the object to be stopped by the invention.

Figure 5A:
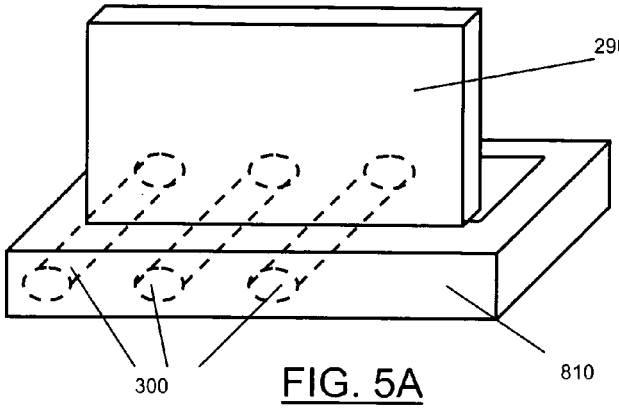
FIGS. 5A, 5B, 5C and 5D are illustrations of a wall-like barrier structure utilizing multiple gas generators.
Figure 5B:
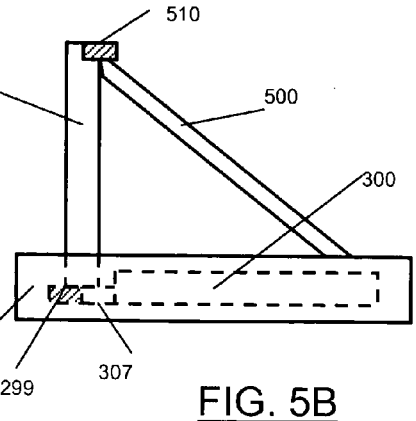
Figure 5C:
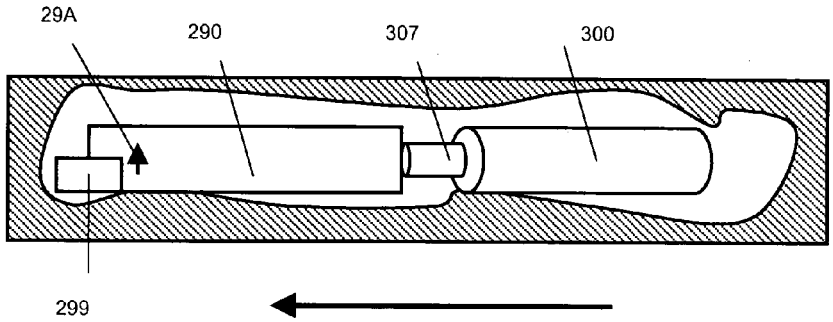
Figure 5D:
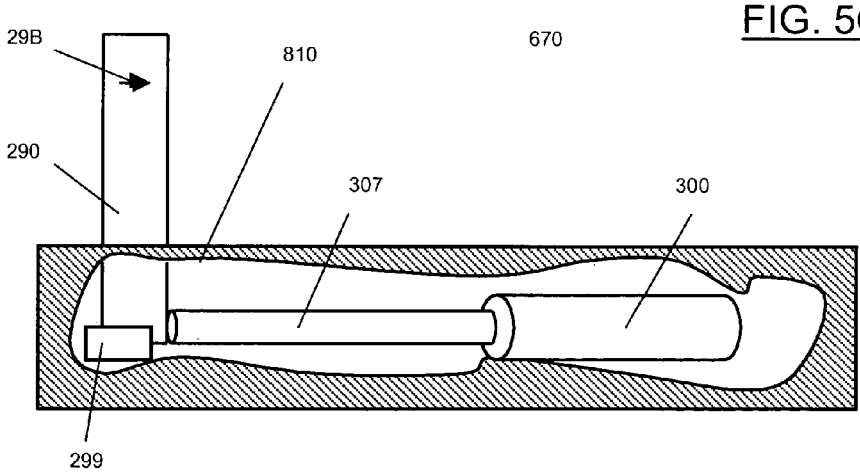

FIGS. 5A, 5B, 5C and 5D illustrate an embodiment wherein the barrier component 290 is propelled into a deployed position by multiple gas generators or gas generator/cylinder combinations 307. FIG. 5A illustrates a front perspective of 3 cylinders 300 oriented horizontally within the housing 810 and substantially normal to the broad, wall-like barrier 290. This horizontal orientation is also illustrated in FIG. 5B, being a side view schematic, including the barrier component 290, housing 810 and cylinder 300. FIG. 5B also illustrates the piston component 307 that, depending upon the configuration, may be the second inner cylinder. Also illustrated is the locking mechanism 299, the pivot mechanism 510, and the structural support mechanism 500. FIGS. 5C and 5D are more detailed side schematics of the housing 810, with the raisable barrier component 290, locking mechanism 299, gas generator/first cylinder 300 and piston/second cylinder 307. The direction of movement of the piston component 307 upon activation of the gas generator is shown by vector arrow 670. The change in orientation of the barrier component is illustrated by the arrow 29A 29B marking the side of the barrier component 290. This embodiment utilizing multiple gas generators allows a heavier or broader (wall like) barrier component to be deployed.

Figure 6:
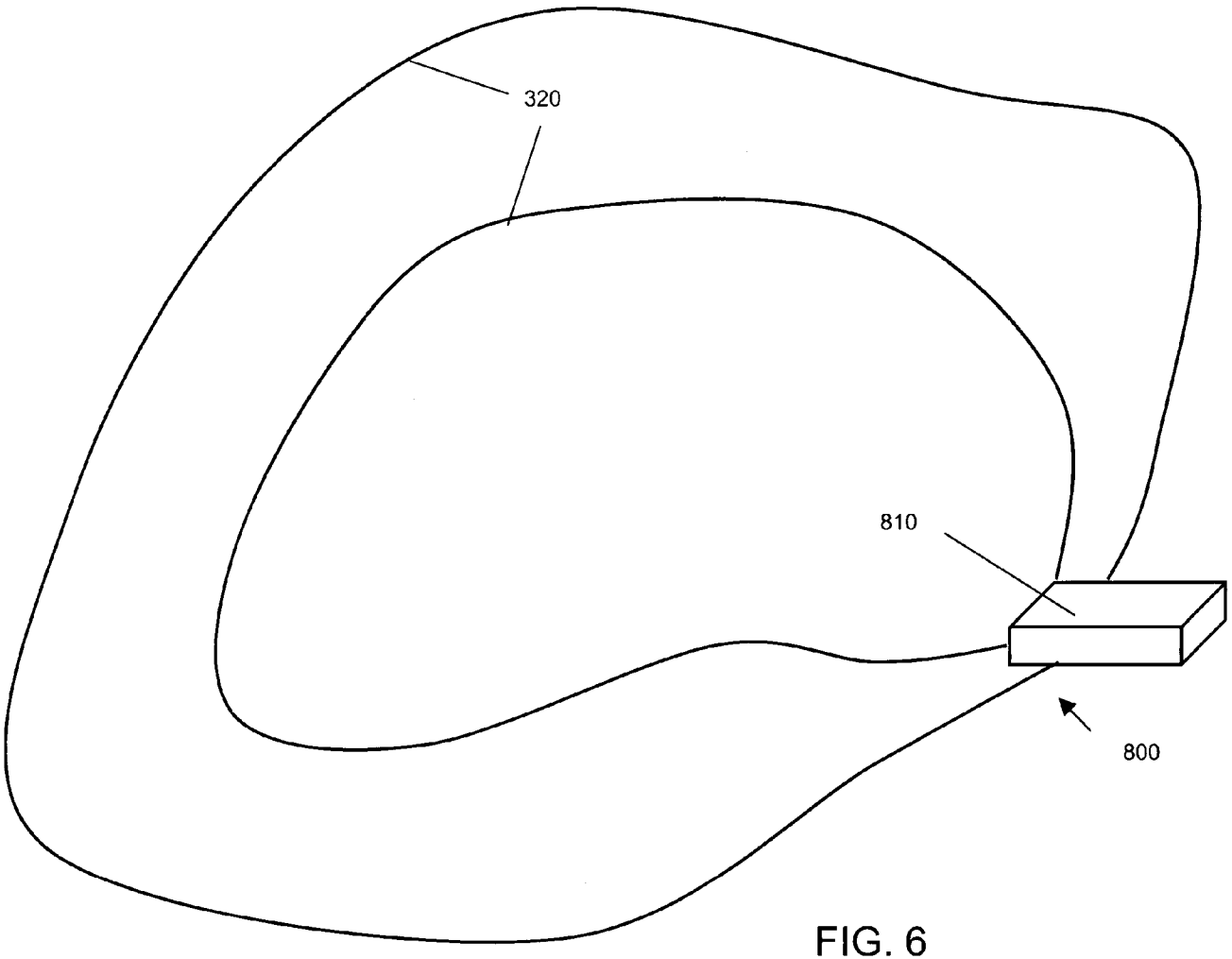
FIG. 6 is an illustration of the invention having a flexible sensor triggering device.

FIG. 6 illustrates another embodiment of the barrier system 800 wherein the sensor mechanism 320 is a flexible pressure responsive device that can be placed on the ground surface at a varying distance and geometry relative to the housing 810 containing the barrier. The sensor is utilized to trigger activation of the gas generator within the housing, 810 for deployment of the barrier component (not shown).

Figure 3:
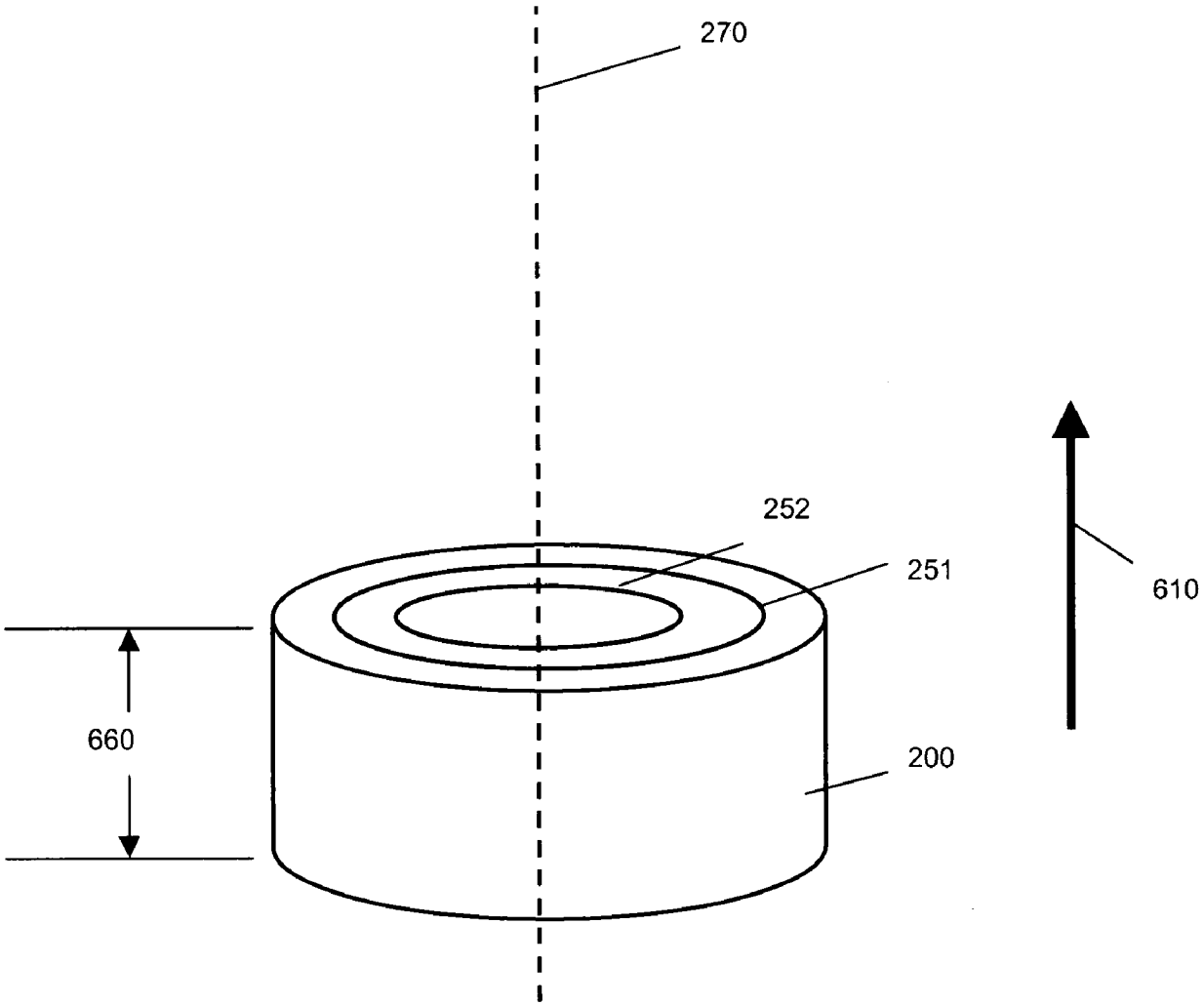
FIG. 3 illustrates a barrier system comprising telescoping cylinders.
Figure 3A:
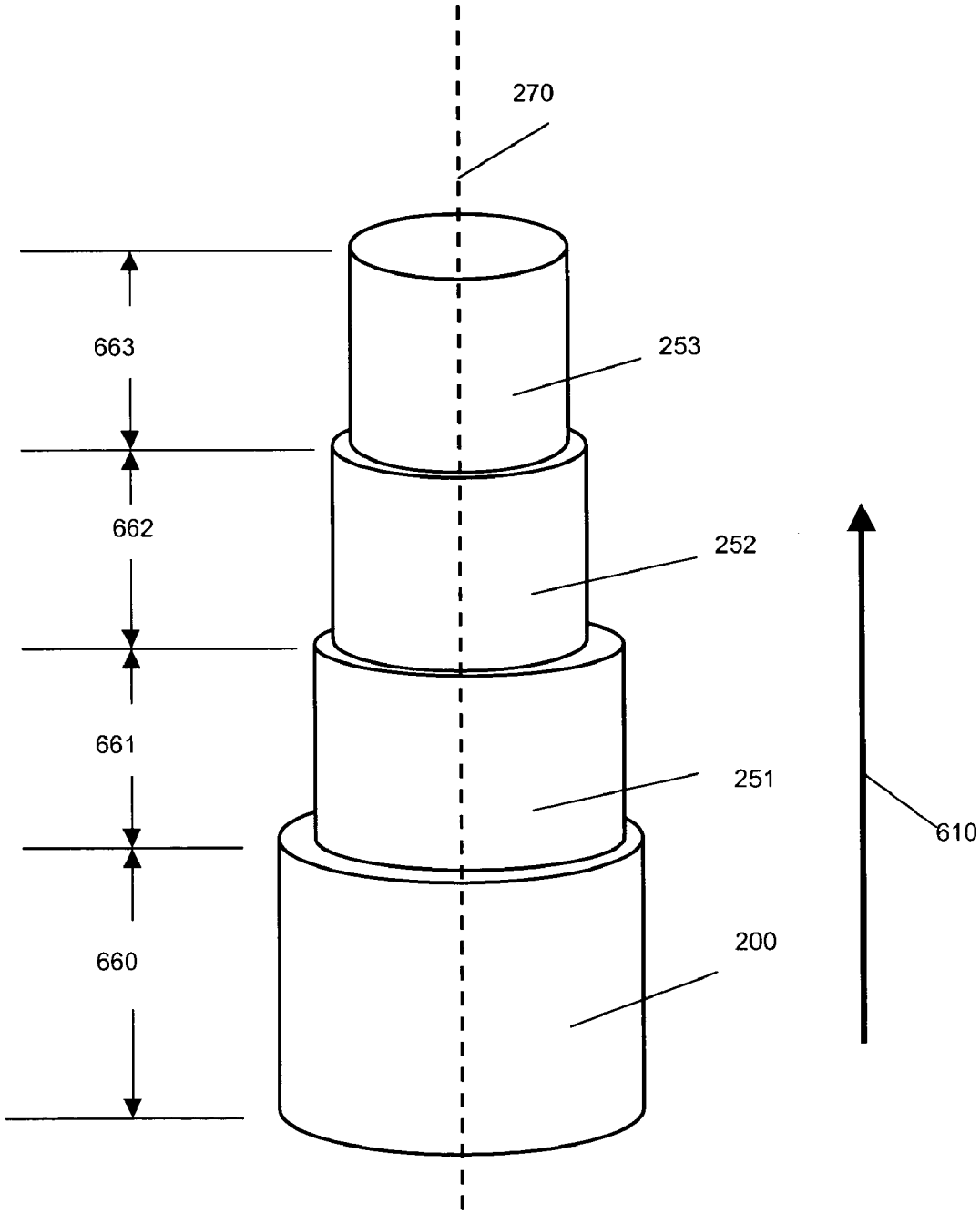
FIG. 3A illustrates a barrier system deployed after a triggering event.

FIG. 3 illustrates another embodiment of the invention that permits a barrier to be deployed without installation of components below the ground surface. The barrier illustrated comprises three nested cylindrical components 200, 251, 252 having a common longitudinal axis of orientation 270. It will be understood that the axis of orientation 270 is substantially orthogonal to the plane of the ground surface (not shown). It wilt be appreciated that the number of nesting cylinder components can vary. The height of the system 660 is increased when the multiple nested cylinders are triggered and deployed upward by operation of the gas cylinder (not shown) in the direction indicated by vector arrow 610.

FIG. 5A illustrates a similar embodiment having 4 nested cylindrical components 200, 251, 252, 253 having a common longitudinal axis of orientation 270. This embodiment illustrates the cylinders deployed upward (vector arrow 610) in response to a triggering event. When deployed the height of the effective barrier increases from the height 660 of the single cylinder 200 to the combined deployed height 660+661+662+662 of the four cylinders 200, 251, 252, 253. It will be appreciated that the effective height 661, 662, 663 contributed by the upper nesting cylinders will be less due to the requirement that there be a locking mechanism (not shown) securing each cylinder from vertical and lateral forces. The locking or security mechanisms prevent the cylinders of the barrier component from separating or collapsing after the gas cylinder discharges. These mechanisms may include, but are not limited to springs or cam activated pins or ratchets.

Figure 3B:
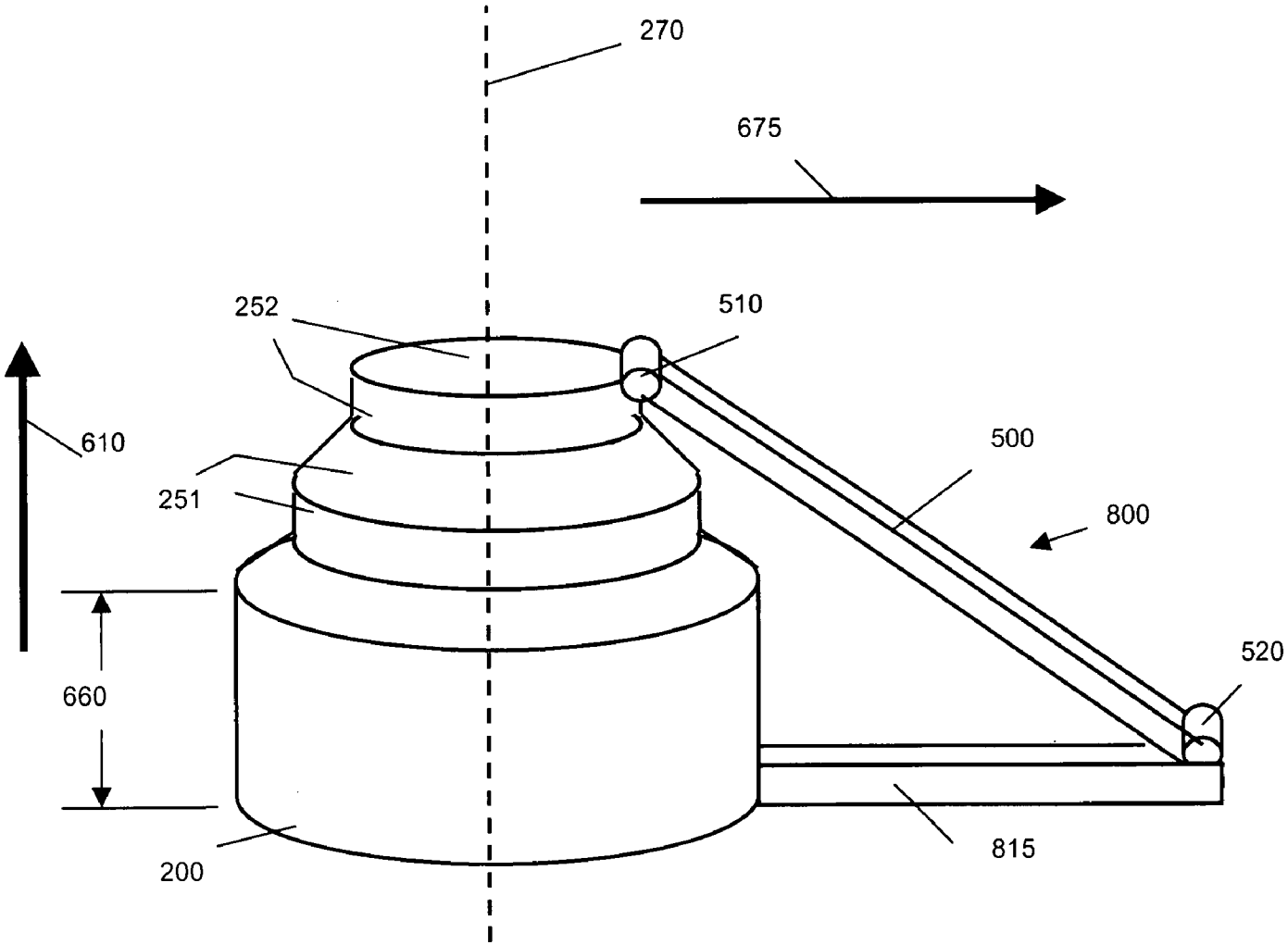
FIG. 3B illustrates an embodiment utilizing a plurality of telescoping barrier sections with a structural support.

FIG. 3B illustrates another embodiment incorporating the telescoping action of nested cylinders 200, 251, 252 combined with a structural support member 500 providing added lateral strength (vector arrow 675). Again, the telescoping cylinder components are deployed upward (vector arrow 610) along a shared common longitudinal axis 270 that is substantially orthogonal to the plane of the ground surface (not shown). The structural member 500 is hingeably attached 510 to a component of the upper/inner nested cylinder 252 and hingeably attached to a connecting component 815.

FIGS. 8, 8A and 8B further illustrate a portable, rapidly deployable embodiment of the invention that does not require installation below the ground surface. The barrier mechanism can be either the stability member and structural support powered by a gas cylinder, or the telescoping nested cylinders, also triggered by a gas cylinder, in the embodiment illustrated, the barrier structure is contained in one section 810 of a multi-section 810, 811 system hingeably attached 410. The multiple sections can be deployed utilizing the hinge component 410. Also attached may be one or more ramp plates 820 hingeably 411 attached to a component section 810, 811. FIG. 8A illustrates components 275, 500 of the barrier system within one section 810. FIG. 8B illustrates the installed system on the ground surface (not shown), comprising the ramp plates, 820 attached to the sections 811, 810, a pressure sensor 320 to trigger the barrier components 275, 500 and the connecting hinges 410, 411. Note that the pressure sensor is placed in a location to be triggered by a vehicle (not shown) passing over the sensor in the direction of vector arrow 675. (Reference is made to FIGS. 10 and 10A.)

Figure 9:
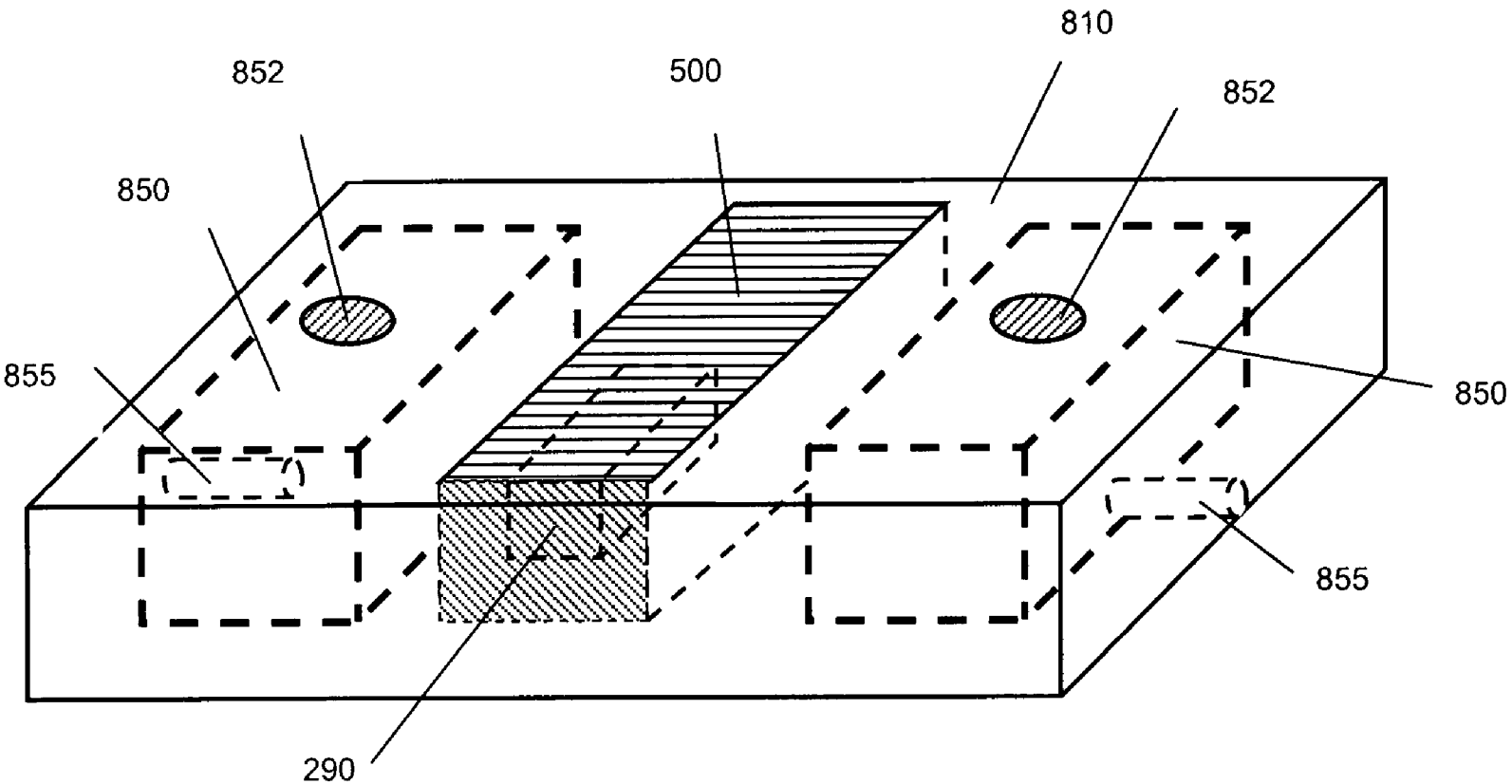
FIG. 9 illustrates an embodiment of the invention incorporating means to add mass to the system.
Figure 10:
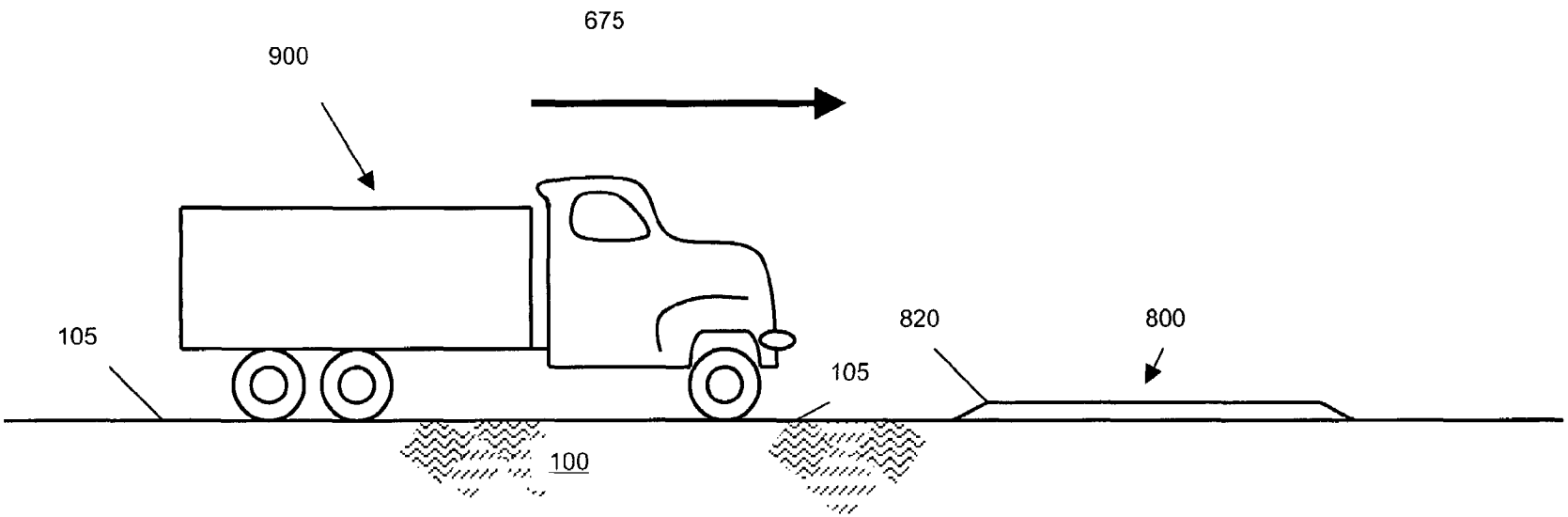
FIGS. 10 and 10A illustrate the installation and deployment of one embodiment of the invention in relationship to an approaching vehicle.

FIG. 9 illustrates an embodiment wherein the housing component 810 can contain holding compartments 850 for placement of additional mass such as sand or earth shoveled from the ground proximate to the area where the housing is placed, or water or other fluid. FIG. 9 illustrates openings 852 in each compartment and drain openings 855. It will be appreciated that other configurations are possible and that the drains will have control values or plugs and that the fill holes may have covers. Also illustrated is the approximate location of the barrier component 290 within the housing and the covering/support structure 500. This will allow the invention to be of minimized weight for transport and installation, yet readily supplemented with additional and removable mass to fix the barrier system at the selected location on the ground surface. As illustrated in FIG. 10 discussed below, the mass of the object to be stopped by the system may also be used for this purpose.

FIG. 10 illustrates a vehicle 900 approaching an embodiment of the invention device 800 in the direction of shown by a vector arrow 675. The vehicle is traveling across the ground surface 105 and the invention is installed on the ground, in contrast to being buried in the ground 100. There is a mass-pressure sensitive triggering mechanism 820 in the front portion of the barrier housing.

Figure 10A:
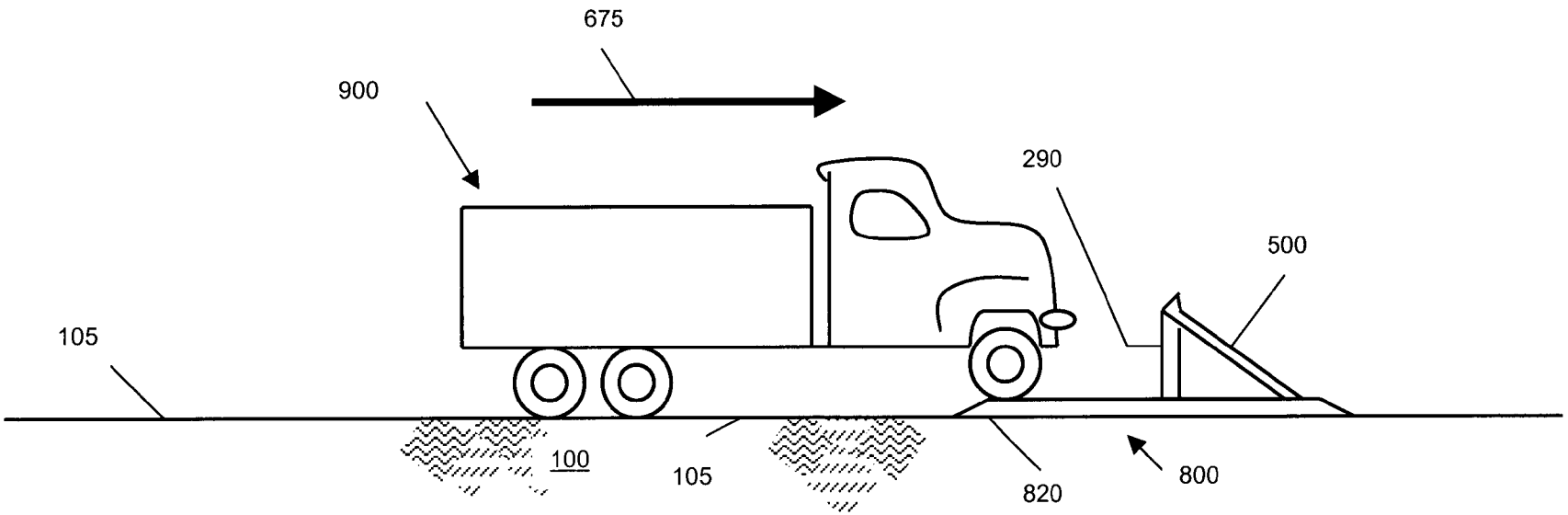

FIG. 10A illustrates the barrier 800 activated by the vehicle striking the pressure sensor device 320. The weight of the vehicle 900 assists in anchoring the barrier in place and allowing the stability structure 290 to stop the vehicle. Also illustrated is the reinforcing structural member 500.

This specification is to be construed as illustrative only and is for the purpose of teaching those skilled in the art the manner of carrying out the invention. It is to be understood that the forms of the invention herein shown and described are to be taken as the presently preferred embodiments. As already stated, various changes may be made in the shape, size and arrangement of components or adjustments made in the steps of the method without departing from the scope of this invention. For example, equivalent elements may be substituted for those illustrated and described herein and certain features of the invention may be utilized independently of the use of other features, all as would be apparent to one skilled in the art after having the benefit of this description of the invention.

Further modifications and alternative embodiments of this invention will be apparent to those skilled in the art in view of this specification.

What we claim is:

1. A portable ground surface risible barrier apparatus deployed by activation of a gas generator from a position in a plans substantially parallel to the ground surface comprising:

a. a gas generator within a first cylinder wherein the cylinder comprises a closed first end attached to a base;

b. second component moveable within the first cylinder in response to activation of the gas generator wherein the first cylinder and the second moveable component have an axis of orientation within a plane substantially parallel to a ground surface; and c. said second component pivotally connected to a first end of a barrier having a first and second end to push the first barrier end along the axis of orientation and the second end in an upright direction from the plane in response to the movement of the second component.

2. The apparatus of claim 1 wherein the second component comprises a piston.

3. The apparatus of claim 1 wherein the second component comprises a cylinder.

4. The apparatus of claim 1 further comprising a structural member pivotally attached to the second barrier end and pivotally attached to the base.

5. The apparatus of claim 4 wherein the structural member is a single piece.

6. The apparatus of claim 1 wherein the base further comprises a locking component to hold the first end of the barrier.

7. The apparatus of claim 1 further comprising a sensor for activating the gas generator.

8. The apparatus of claim 1 further comprising a plurality of first cylinders, second components and gas generators.

9. The apparatus of claim 1 wherein the barrier component further comprises a longitudinal axis of orientation substantially orthogonal to the plane after activation of the gas cylinder.

10. The apparatus of claim 1 further comprising at least one compartment within the base for holding variable quantities of additional weight prior to activation of the gas cylinder.

11. The apparatus of claim 10 wherein the compartment can be controllably filled and drained of fluid.

12. The apparatus of claim 1 wherein the barrier can be deployed in at least 150 milliseconds and can stop an object weighing 15000 lbs and traveling 50 mph.

13. The apparatus of claim 1 further comprising a sensor and communication component to activate the gas generator.

14. The apparatus of claim 13 wherein the sensor detects movement of an object.

15. The apparatus of claim 13 wherein the base component contains the sensor mechanism.

16. The apparatus of claim 13 wherein the base component contains a power source.

17. The apparatus of claim 13 wherein the sensor mechanism detects compression.

18. The apparatus of claim 13 wherein the sensor mechanism utilizes RF signals.

19. The apparatus of claim 13 wherein the sensor mechanism utilizes acoustic signals.

20. The apparatus of claim 13 wherein the sensor mechanism utilizes light signals.

21. The apparatus of claim 1 wherein the mass of an object to be stopped by the barrier is used to secure the barrier system in a fixed location.

22. A ground level protective barrier system that can be placed on a ground surface comprising:

a. a cylinder containing a gas generator and said cylinder comprising an axis of orientation substantially parallel to the ground end comprising a first end and a second end wherein the first cylinder end is closed and connected to a base;

b. a moveable piston comprising a first end located within the cylinder and a second end that can be extended along the axis of orientation past the second end of the cylinder in response to activation of the gas generator;

c. a barrier component comprising a first end and a second end wherein the first barrier end is pivotally attached to the second end of the piston and the first barrier end moves along the axis of orientation in response to activation of the gas generator; and d. a structural member comprising a first end and a second end wherein the first end of the structural member is pivotally attached to the second end of the barrier and the second end of the structural member is pivotally attached to the base proximate to the connection of the first cylinder end.

23. A ground level protective barrier system comprising:

a. a housing component that can be placed on a ground surface comprising i. at least one first cylinder having a first end and a second end wherein the first end is closed;

ii. a first connector holding the first end of the first cylinder to a housing;

iii. at least one second component located partially within the first cylinder and having a separate first end and a second end and having the same longitudinal axis of orientation of the first cylinder and moveable in relation to the first cylinder along the axis of orientation so that the second end of the said component can be extended past the second end of the first cylinder;

iv. the first cylinder and second component having an axis of orientation substantially parallel to the ground surface;

v. a gas generator located within the first cylinder to move the second component along the longitudinal axis of orientation in a manner that the second end of said component extends from the second end of the first cylinder;

vi. a barrier component having a first end and second end;

vii. a first pivot component connecting the first end of the barrier component to the second end of the second component;

viii. a locking mechanism fixed to the housing to lock the first end of the barrier component into a fixed position on the housing;

ix. a structural member having a first end and a second end;

x. a second pivot component connecting the second end of the barrier component to the first end of the structural member;

xi. a third pivot component connecting the second end of the structural member to the first connector of the housing;

b. a sensor component;

c. a communication component to convey an activation signal from the sensor component to the gas generator; and d. a power source.

* * * * *